US008096434B2

(12) United States Patent
Bunel et al.

(10) Patent No.: US 8,096,434 B2
(45) Date of Patent: Jan. 17, 2012

(54) CONTAINER, IN PARTICULAR A BOTTLE, MADE OF THERMOPLASTIC MATERIAL

(75) Inventors: Christophe Bunel, Octeville sur Mer (FR); Laurent Penet, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 240 days.

(21) Appl. No.: 11/886,687

(22) PCT Filed: Mar. 20, 2006

(86) PCT No.: PCT/FR2006/000607

§ 371 (c)(1),
(2), (4) Date: Sep. 19, 2007

(87) PCT Pub. No.: WO2006/100374

PCT Pub. Date: Sep. 28, 2006

(65) Prior Publication Data

US 2009/0218308 A1 Sep. 3, 2009

(30) Foreign Application Priority Data

Mar. 23, 2005 (FR) ..... 05 02895

(51) Int. Cl.
*B65D 1/02* (2006.01)

(52) U.S. Cl. ..... 215/376; 215/370; 215/373; 215/375; 215/382; D9/516; D9/520; D9/538; D9/552; 220/606; 220/609; 220/608

(58) Field of Classification Search ..... 215/370, 215/376, 373, 374, 375; 220/606, 609, 608; D9/516, 520, 538, 552
See application file for complete search history.

(56) References Cited

U.S. PATENT DOCUMENTS

| | | | | |
|---|---|---|---|---|
| 4,247,012 | A | 1/1981 | Alberghini et al. | |
| 4,850,494 | A * | 7/1989 | Howard, Jr. | 215/375 |
| 5,713,480 | A | 2/1998 | Petre et al. | |
| D465,727 | S * | 11/2002 | Duranthon | D9/620 |
| 7,051,889 | B2 * | 5/2006 | Boukobza | 215/375 |
| D530,615 | S * | 10/2006 | Darr et al. | D9/516 |
| D546,699 | S * | 7/2007 | Bourne | D9/552 |
| D546,700 | S * | 7/2007 | Bourne | D9/552 |
| D556,044 | S * | 11/2007 | Hirata | D9/538 |
| D556,580 | S * | 12/2007 | Yamada | D9/520 |
| D572,143 | S * | 7/2008 | Laupie | D9/620 |
| D579,337 | S * | 10/2008 | Druart et al. | D9/538 |
| 7,543,713 | B2 * | 6/2009 | Trude et al. | 215/373 |
| 7,574,846 | B2 * | 8/2009 | Sheets et al. | 53/440 |
| 2003/0052076 | A1 | 3/2003 | Cheng et al. | |
| 2004/0211746 | A1 * | 10/2004 | Trude | 215/374 |

FOREIGN PATENT DOCUMENTS

| | | | |
|---|---|---|---|
| FR | 2 796 919 A | 2/2001 | |
| FR | 2796919 A1 * | 2/2001 | 215/374 |
| JP | 2000 229615 A | 8/2000 | |

* cited by examiner

*Primary Examiner* — Anthony Stashick
*Assistant Examiner* — Cynthia Collado
(74) *Attorney, Agent, or Firm* — Sughrue Mion, PLLC

(57) ABSTRACT

A thermoplastic container, in particular a bottle, made by blow-molding or stretch blow-molding of a heated preform and including a bell-shaped convex base with its concavity facing outward and provided with reinforcing impressions projecting inward and radiating around a central recess, the impressions having a trapezoid shape with its smaller dimension located toward the center of the base; the impressions include respective arches which form convex trapezoid segments with concavity facing inward and extending from the seat to the central recess by being connected thereto immediately proximate the upper end of the central recess.

22 Claims, 1 Drawing Sheet

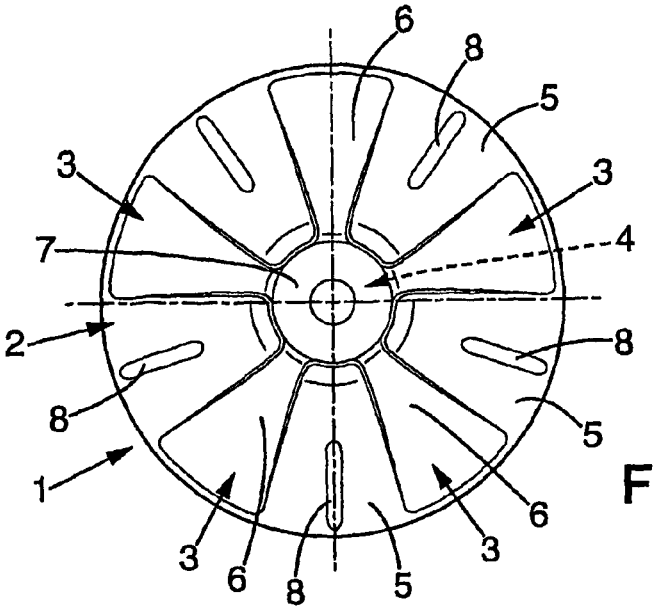
FIG. 1
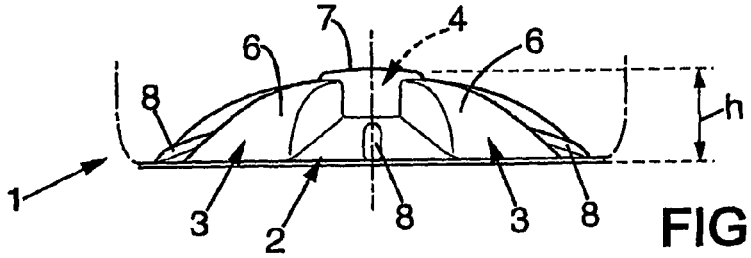
FIG. 2
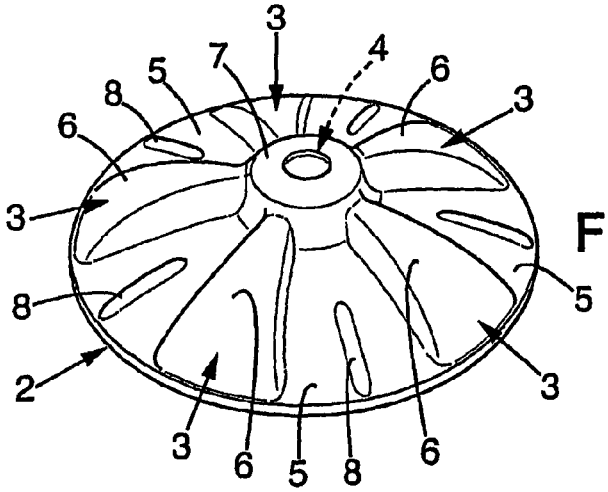
FIG. 3
FIG. 4
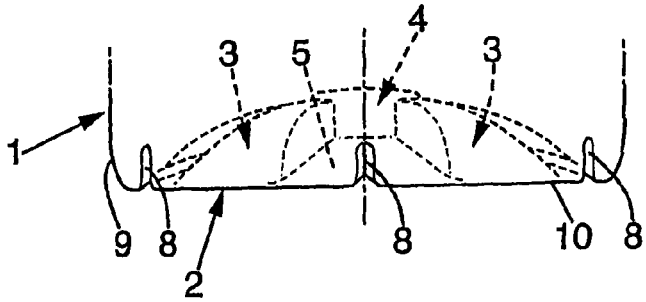

CONTAINER, IN PARTICULAR A BOTTLE, MADE OF THERMOPLASTIC MATERIAL

FIELD OF THE INVENTION

The present invention relates to the general field of containers, especially bottles, made of a thermoplastic such as PET, manufactured by the blow molding or stretch blow molding of a heated perform, and it relates more specifically to improvements made to those of such containers which possess a bottom which is domed, so as to have the general shape of a spherical cap with its concavity facing the outside of the container, and which defines an annular seat, said bottom having reinforcing impressions protecting toward the inside of the container and radiating around a central indentation or central recess, said impressions having an approximately trapezoidal general shape with the short side located toward the center of the bottom of the container, the long side located toward the periphery of the bottom of the container and a bottom that constitutes the arch of the impression.

BACKGROUND OF THE INVENTION

Containers intended for containing a still liquid (for example bottles designed to contain table water) are, in most cases, provided with a domed bottom having the general shape of a spherical cap with its concavity facing the outside and of relatively small height. Such bottoms are often provided with radiating ribs spaced apart around a central indentation, it being possible for said ribs to have various conformations and optionally to extend over the base of the wall of the body so as to reinforce the seat (the peripheral region via which the bottom rests on a support). Typically, the height of the bottoms of this kind, central indentation included, is typically around 10 mm, and may be up to 15 mm.

Such bottoms are shaped so as to support, without deforming, the column of flat liquid sitting on top of them. However, they do not have sufficient strength to withstand an additional stress, for example due to internal overpressure, even slight overpressure.

In the case of carbonated liquids (for example those under a pressure of around 3 to $4\times10^5$ Pa, or even up to $10\times10^5$ Pa), it is known to design containers with a bottom having a much more pronounced curvature (called "champagne" bottom or the like) capable of withstanding high pressures without deforming. However, such bottoms require a larger amount of thermoplastic, both because of their greater height and because of the greater wall thickness, at least locally. Containers provided with such bottoms therefore prove to be more expensive and it is more difficult to shape them correctly during molding.

It is known, when packaging certain easily oxidizable still liquids, to pour a small amount of liquid (for example one drop) of an inert and rapidly vaporizing substance (for example liquid nitrogen) on the surface of the still liquid at the end of the container-filling phase so as to remove the air (and therefore the oxygen contained in the air) from the free volume sitting on top of the liquid surface immediately before stoppering the container (an operation called "inerting") or to improve the pressurization of the container in the case of lightly carbonated liquids. This small amount of inert substance ends up by being vaporized once the stoppering operation has been completed, so that there remains, in the closed container, some inerting gas under a low residual pressure of less than $2\times10^5$ Pa, typically around $1\times10^5$ Pa or even around $0.5\times10^5$ Pa.

The slightly domed bottoms conventionally provided for containers intended for still liquids are not capable of certainly withstanding, without deforming, a pressure as low as that mentioned above. As regards the use of more resistant bottoms, such as champagne bottoms, their high strength and the additional cost associated with them appear excessive for the envisaged application.

SUMMARY OF THE INVENTION

It is in this context that the invention aims to provide improved shaping of the domed bottom for containers suitable for being filled with flat liquids and closed off in the presence of a relatively low pressure, not exceeding $2\times10^5$ Pa, and more generally around $1\times10^5$ Pa, requiring only a minimum of thermoplastic, easy to shape correctly under the usual conditions for the blow molding or stretch blow molding of containers intended for still liquids, and having a height of the same order of magnitude as that of the bottoms of conventional containers for still liquids.

For these purposes, a container designed as mentioned in the preamble, being designed in accordance with the invention, is characterized in that the impressions comprise respective arches that form domed trapezoidal segments with their concavity facing toward the inside of the concavity of said spherical cap formed by said bottom of the container (in other words facing toward the outside of the container) and extending from the seat to the central indentation by being connected to the latter in the immediate vicinity of the upper end of the central indentation.

Admittedly, it is known to provide certain types of container, such as those designed to be filled with a hot liquid, with bottoms having inwardly projecting reinforcing impressions radiating around a central indentation, said impressions having an approximately trapezoidal general shape with the short side located toward the center of the bottom of the container.

However, in these known containers, such impressions have an arch of substantially flat general shape. Container bottoms thus designed with approximately trapezoidal impressions with a substantially flat arch are admittedly quite satisfactory for being filled with a hot liquid, but they are not however suitable within the envisioned context of a residual overpressure of relatively small value.

A bottom designed according to the invention has on the contrary a double structure of domed panels, both as regards the panels defined between the projecting impressions in the bottom of the container itself and as regards the arches of said impressions having a double concavity with the same orientation facing toward the outside of the container. This constitutes a double buttressing system on two levels which, without being capable of withstanding high pressures, is however capable of withstanding, without deforming appreciably, a relatively low residual pressure not exceeding about $2\times10^5$ Pa, such as that which remains after an inerting operation.

In a preferred embodiment, the arches of the impressions have a variable curvature, being greater toward the seat than toward the central indentation.

To increase the deformation resistance of the container bottom, it is advantageous for said panels defined between the projection impressions in the bottom of the container to be provided with at least one respective radiating rib. In one specific exemplary embodiment, a single radiating rib is provided on each bottom panel.

In practice, it is simple to ensure that the ribs are substantially straight, that they advantageously have a concavity facing toward the outside and that, preferably, their inner end is located at some distance from the central indentation, in other words that the ribs extend radially only over part of the gap between the seat and the central indentation (for example over about one half of this gap) starting from the seat.

However, if so needed, it is possible to provide, instead of ribs, reinforcing reliefs having any other desirable shape (for example triangular shape).

Depending on the desired degree of stiffening, provision may be made for the ribs to extend only along the bottom as far as close to the seat of the latter or else, alternatively, to extend beyond the seat, rising up over the base of the body of the container if it is desirable to strengthen the seat.

In a current field of application, especially as regards bottles, the bottom is of round general shape and the impressions are angularly spaced apart equidistantly. Typically, for current bottles with a diameter of around 50 to 70 mm, the number of impressions is between 3 and 8.

BRIEF DESCRIPTION OF THE INVENTION

The invention will be more clearly understood upon reading the following detailed description of certain preferred embodiments given solely by way of purely illustrative examples. In this description, reference is made to the appended drawing in which:

FIG. 1 is a top view of a preferred embodiment of a container bottom designed in accordance with the invention;

FIG. 2 is a side view of the base of a container equipped with the bottom of FIG. 1 (the side wall of the container only being suggested);

FIG. 3 is a three-quarter perspective view from above of the bottom shown in FIG. 1; and FIG. 4 is a side view of an alternative embodiment of the base of a container designed according to the invention.

DETAILED DESCRIPTION OF THE INVENTION

Although the provisions according to the invention may be applicable in bottoms of various shapes equipping containers of various shapes and dimensions, the figures illustrate, merely by way of example, a bottom with a round general outline for equipping a container of axisymmetric cylindrical general shape, such as a bottle intended to contain a still liquid before undergoing an inerting treatment at the bottling stage.

Referring now to FIGS. 1 to 3, the reference 1 denotes a container in its entirety, such as a bottle, made of a thermoplastic such as PET and manufactured by blow molding or stretch blow molding a heated perform. The container 1 has a bottom 2 which is domed, so as to have the general shape of a spherical cap with its concavity facing the outside of the container (it is therefore the convex face of this bottom which is seen in FIG. 1), and which defines an annular seat 10, that is to say an annular part of the bottom via which the latter rests on a support. The bottom 2 has reinforcing impressions 3, projecting toward the inside of the container and radiating around a central indentation 4 or central recess. The impressions 3 have an approximately trapezoidal general shape with the short side located toward the center of the bottom and the long side located toward the seat 10 of the bottom. As may be better seen in FIGS. 1 and 3, the short side of each approximately trapezoidal impression 3 has, in the example illustrated, a very small dimension so that the impression has an almost triangular general shape with the apex located toward the center.

Under these conditions, the impressions 3 define, between them, bottom panels 5 which are themselves also of approximately trapezoidal general shape with the short side located toward the center of the bottom and the long side located toward the seat. The panels 5, being portions of the bottom 2, are domed, as can be clearly seen in FIGS. 2 and 3.

According to the invention, the arches 6 of the impressions 3 form domed trapezoidal segments with their concavity facing toward the inside of the concavity of said spherical cap formed by the bottom 2 of the container (in other words with its concavity facing toward the outside of the container) and extend from the seat 10 to the central indentation by being joined to the latter in the immediate vicinity of the upper end 7 of the central indentation 4.

As may be particularly clearly seen in FIG. 3, the panels 5 of the bottom and the arches 6 of the impressions 3, which alternate with one another, form a domed double structure lying on two levels and centered on the central indentation 4 with a double concavity of the same orientation facing toward the outside of the container. Such an arrangement provides greater mechanical strength, which allows the bottom to be able to withstand, without appreciable deformation, when the container is filled with a still liquid, a slight overpressure not exceeding about $2\times10^5$ Pa and in practice around 0.5 to $1\times10^5$ Pa, as is the case for example following an inerting operation or pressurizing operation in order to stiffen the container.

Furthermore, such a container bottom may be produced without substantial localized overthicknesses—in other words it may be formed under substantially the same molding conditions as for standard bottoms.

Finally, the height h of a container bottom 2 designed according to the invention may be of the same order of magnitude as that of a standard container bottom for a flat liquid, that is to say around 10 to 15 mm for a container such as a bottle with a diameter of 50 to 70 mm.

In order for the arches of the impressions to have greater strength, it is advantageous for them to have a variable curvature, being greater toward the seat than toward the central indentation 4.

Preferably, to obtain greater stiffness of the panels 5 of the container bottom 2 between the impressions 3, the impressions 3 of the bottom 2 are separated by panels 5 that may be provided with at least one respective radiating rib 8. In practice, to make it easier to form the bottom 2 correctly, only a single radiating rib 8 is provided in each panel 5.

Although many configurations of ribs may be employed, it is however simpler, when etching the mold, for the ribs 8 to be substantially straight and advantageously for them to have a concavity facing toward the outside, as shown in FIGS. 1 to 3. Should it be necessary, the panels 5 may be reinforced by means of reliefs having other shapes (for example reliefs of triangular shape). It is not essential for the ribs 8 to extend over the entire gap separating the seat 10 from the central indentation 4. In the exemplary embodiment illustrated in the appended figures, the ribs 8 extend only over part of the aforementioned gap (about one half of this gap in the configuration shown) and the end of the ribs 8 lying radially toward the inside is at a distance from the central indentation 4.

Moreover, on the side where the ribs 8 have their ends facing radially outward, it is conceivable for them to extend to a point close to the seat 10 or, as an alternative, to extend beyond the seat 10, rising up over the base of the body 9 of the container 1 as illustrated in FIG. 4, the purpose of the latter arrangement being to strengthen the seat 10.

One common, although not exclusive, application of the provisions of the invention is for containers of approximately axisymmetric cylindrical general shape such as bottles. The bottom 2 then generally has a round shape, as shown in FIGS. 1 to 4, and in this case the impressions 3 are angularly spaced apart equidistantly. In practice, to reach an acceptable compromise between sufficient strengthening of the bottom 2 (which would require a relatively large number of impressions 3 and interspersed panels 5) and correct shaping of the bottom 2 during molding (which would require a relatively small number of reliefs), the number of impressions provided is between 3 and 8, the specific examples shown in FIGS. 1 to 4 having five impressions 3 alternating with five bottom panels 5.

The invention claimed is:

1. A container made of a thermoplastic, manufactured by blow molding or stretch blow molding of a heated perform, said container having:

a bottom which is domed, so as to have a general shape of a spherical cap which comprises a concavity facing an outside of the container, and defines an annular seat which extends along a periphery of the bottom, said bottom having reinforcing impressions projecting toward an inside of the container and radiating around a central indentation formed in the bottom, each of said reinforcing impressions comprising:

domed trapezoidal segments of an approximately trapezoidal general shape with a short side located toward a center of the bottom;

a concavity facing toward an inside of the concavity of the spherical cap, an arch that forms an upper surface of each of the domed trapezoidal segments, the arch starting at the annular seat and extending to the central indentation as a single continuous concave surface, and two side walls which oppose one another and extend from the bottom to the upper surface of the domed trapezoidal segments, wherein each wall has an upper edge which is continuously smoothly curved with a curvature of the same sign along an entire length of the upper edge and extends from the annular seat to the short side of a corresponding domed trapezoidal segment, each arch extends between the upper edges of corresponding two side walls, and the concavities of said reinforcing impressions and the concavity of said spherical cap form a double structure with a double concavity of the same orientation.

2. The container as claimed in claim 1, wherein the arches of the impressions have a variable curvature, such that the curvature of each of the arches is greater toward the seat than toward the central indentation.

3. The container as claimed in claim 1, wherein the impressions of the bottom are separated by panels that are provided with at least one respective radiating rib.

4. The container as claimed in claim 3, wherein the panels of the container bottom that are defined between the impressions are provided with a single respective radiating rib.

5. The container as claimed in claim 3, wherein the ribs are substantially straight.

6. The container as claimed in claim 3, wherein the ribs have an outwardly facing concavity.

7. The container as claimed in claim 3, wherein each rib extends only over part of the gap between the seat and the central indentation and in that the inner end of the ribs is located at a distance from the central indentation.

8. The container as claimed in claim 3, wherein the ribs extend to a point close to the seat.

9. The container as claimed in claim 3, wherein the ribs extend beyond the seat, rising up over the base of the body of the container.

10. The container as claimed in claim 1, wherein the bottom is of round general shape and the impressions are spaced apart angularly and equidistantly.

11. The container as claimed in claim 10, wherein the number of impressions is between 3 and 8.

12. The container as claimed in claim 1, wherein the container is a bottle.

13. The container as claimed in claim 1, wherein the thermoplastic is PET.

14. The container as claimed in claim 1, wherein the concavity of each of the reinforcing impressions is greater than the concavity of the spherical cap.

15. The container as claimed in claim 1, wherein the container is filled with a liquid and provided with a residual overpressure.

16. The container as claimed in claim 1, wherein the respective arches have multiple radii of curvature.

17. A thermoplastic container manufactured using a blow molding or stretch blow molding method, the thermoplastic container comprising:

a domed bottom having a concavity that faces outwardly such that the domed bottom forms an annular seat along a periphery of the bottom; and reinforcing impressions projecting inwardly from the domed bottom, the reinforcing impressions running in a radial direction from a proximity of a center of the domed bottom to the annular seat and each of the reinforcing impressions comprising:

a concavity facing outwardly toward an inside of the concavity of the spherical cap, an arch that forms an upper surface of each of the reinforcing impressions and extends from the annular seat to the center of the domed bottom as a continuous concave surface, and two side walls which oppose one another and extend from the bottom to the upper surface, an arch that forms an upper surface of each of the domed trapezoidal segments, the arch starting at the annular seat and extending to the central indentation as a single continuous concave surface, and each arch extends between the upper edges of corresponding two side walls.

18. The thermoplastic container according to claim 17, wherein the concavity of each of the reinforcing impressions and the concavity of the domed bottom form a double concavity structure.

19. The thermoplastic container according to claim 17, wherein the reinforcing impressions have an approximately trapezoidal shape with a short side located toward the center of the domed bottom.

20. The thermoplastic container according to claim 17, wherein the concavity of each of the reinforcing impressions is greater than the concavity of the domed bottom.

21. The thermoplastic container according to claim 17, wherein the thermoplastic container is filled with a liquid and provided with a residual overpressure.

22. The thermoplastic container according to claim 17, wherein the reinforcing impressions each has multiple radii of curvature.

* * * * *